United States Patent [19]

Wake et al.

[11] Patent Number: 4,708,335

[45] Date of Patent: Nov. 24, 1987

[54] SHEET PRESENTING ASSEMBLY

[75] Inventors: David E. Wake; Anthony L. Robinson, both of Hampshire; Michel R. Croset, Hants, all of England

[73] Assignee: De La Rue Systems Limited, England

[21] Appl. No.: 881,614

[22] Filed: Jul. 3, 1986

[30] Foreign Application Priority Data

Jul. 4, 1985 [GB] United Kingdom ..... 8516969

[51] Int. Cl.[4] ..... B65H 29/00

[52] U.S. Cl. ..... 271/187; 271/204; 271/277; 271/308; 271/315

[58] Field of Search ..... 271/187, 315, 307, 308, 271/204, 206, 82, 277

[56] References Cited

U.S. PATENT DOCUMENTS 2,850,281 9/1958 Heimlicher ..... 271/187
3,390,508 7/1968 Heimlicher ..... 271/187 X

FOREIGN PATENT DOCUMENTS 702650 2/1941 Fed. Rep. of Germany ..... 271/315
859590 12/1940 France ..... 271/315

*Primary Examiner*—Richard A. Schacher
*Attorney, Agent, or Firm*—Ostrolenk, Faber, Gerb & Soffen

[57] ABSTRACT

A sheet presenting assembly, for example for dispensing banknotes, comprises a rotatably mounted set of stacking wheels (2–5) each having a plurality of sheet receiving slots (7). A stripping device (13) cooperates with the stacking wheels (2–5) in a first position to strip sheets from the stacking wheels to form stack of sheets. The stripping device (13) is movable to a second position in which the stack of sheets (28) is clamped between the stripping device (13) and outer surfaces of two belts (20, 20'). Drive including a drive motor (22) and the belts (20, 20') move the stripping device 13 with the stack of sheets (28) clamped therebetween towards a present station (29).

10 Claims, 2 Drawing Figures

SHEET PRESENTING ASSEMBLY

FIELD OF THE INVENTION

The invention relates to a sheet presenting assembly for presenting a stack of sheets to a present station. The invention has particular application to the dispensing of banknotes but may also be used with other document handling apparatus.

DESCRIPTION OF THE PRIOR ART

There is a continuing requirement for a simple, reliable and economic system for dispensing sheets such as banknotes. Reliability is particularly important in order to minimise the amount of engineer intervention required due to break down of the system. Up to now, relatively complex dispensing systems have been developed and the present invention seeks to overcome or at least to minimise the problems encountered in conventional systems.

SUMMARY OF THE INVENTION

In accordance with the present invention, a sheet presenting assembly comprises a rotatable sheet carrying device having a plurality of sheet receiving slots; a stripping device cooperating in a first position at a stripping station with the sheet carrying device to strip sheets from the sheet carrying device to form a stack of sheets, the stripping device being movable to a second position in which the stack of sheets is clamped between the stripping device and a movable surface; and drive means adapted to move the stripping device and the movable surface with a stack of sheets clamped therebetween to a present station.

The invention simplifies known sheet presenting assemblies by utilising the stripping device not only to strip sheets from the sheet carrying device but also to clamp the stack of sheets while the stack is moved towards a present station (usually associated with a present outlet). This simplifies the construction of the device by reducing the number elements required thus increasing the reliability of the assembly.

In this specification, the phrase "stack of sheets" should be understood to include a single sheet.

Preferably, the stripping device is also movable in cooperation with the movable surface to convey the stack of sheets to a dump station. This is useful where provision is to be made to deal with an incorrectly compiled stack so as to avoid unnecessary down time of the system. In one example, the dump station may be positioned above a dump container into which the stack of sheets falls under gravity. In other examples, the stack may be transferred at the dump station to conveying means for conveying the stack to a dump container.

Movement of the stripping device may be controlled in a number of ways. Preferably, however, at least one portion of the stripping device comprises a cam follower cooperating with a respective cam of the assembly which is fixed relatively to the stripping device whereby movement of the cam follower along the cam in response to movement of the stripping device towards the present station causes the stripping device to move from the first to the second position. When a dump station is provided it is particularly convenient if the cam and cam follower cooperate during movement of the stripping device towards the dump station to cause the stripping device to release the stack.

The movable surface may comprise at least one, preferably two, endless belts coupled to the stripping device and driven by the drive means. In the latter case the surface is defined in two spaced portions.

The drive means may include two drive motors for separably driving the stripping device and movable surface. Preferably, however, the drive means comprises a reversable motor coupled to the stripping device and movable surface. Conveniently, the movable surface is driven by the drive means and is coupled to the stripping device to cause movement of the stripping device. This ensures that both the stripping device and movable surface move at the same speed.

Preferably, the stripping device comprises at least one plate. Conveniently, the or each plate is pivotally mounted relative to the movable surface.

The sheet carrying device may be provided by one or more stacking wheels of conventional form mounted on an axle and arranged to receive single sheets from a conventional sheet supplying device. Where a plurality of stacking wheels are provided, the sheet stripping device preferably comprises a plurality of plates which extend between adjacent pairs of stacking wheels when the stripping device is in its first position at the stripping station.

As previously mentioned the invention is particularly suited for use with banknote dispensing apparatus.

BRIEF DESCRIPTION OF THE DRAWINGS

In order that the invention may be better understood, a preferred embodiment of a sheet presenting assembly in accordance with the invention will now be described with reference to the accompanying drawings, in which.

DETAILED DESCRIPTION OF AN EMBODIMENT

Figure 1:
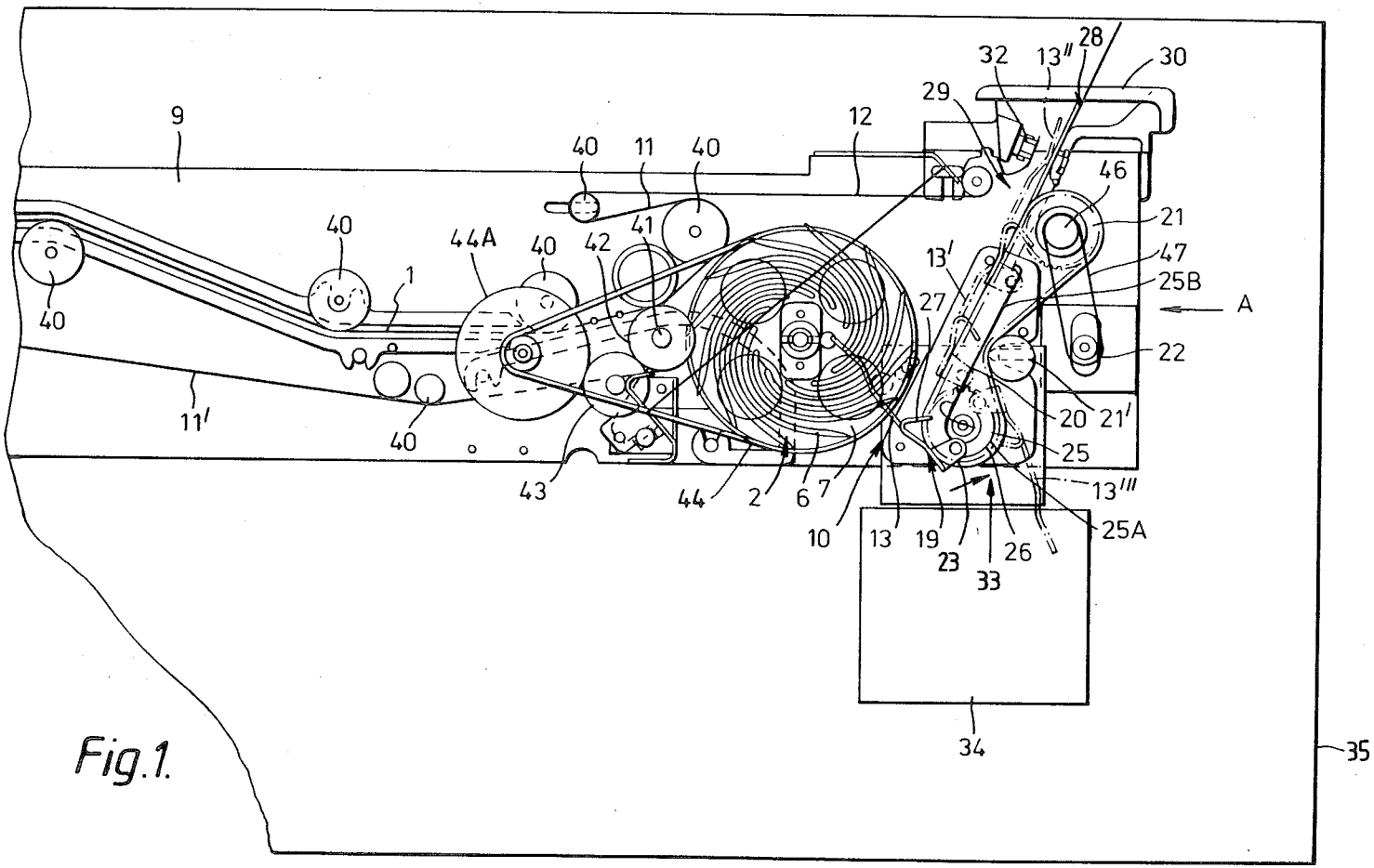
FIG. 1 is a schematic side view of the assembly connected to a sheet feed device; and, FIG. 2 is a view taken in the direction of the arrow A in FIG. 1 with some parts omitted for clarity.
Figure 2:
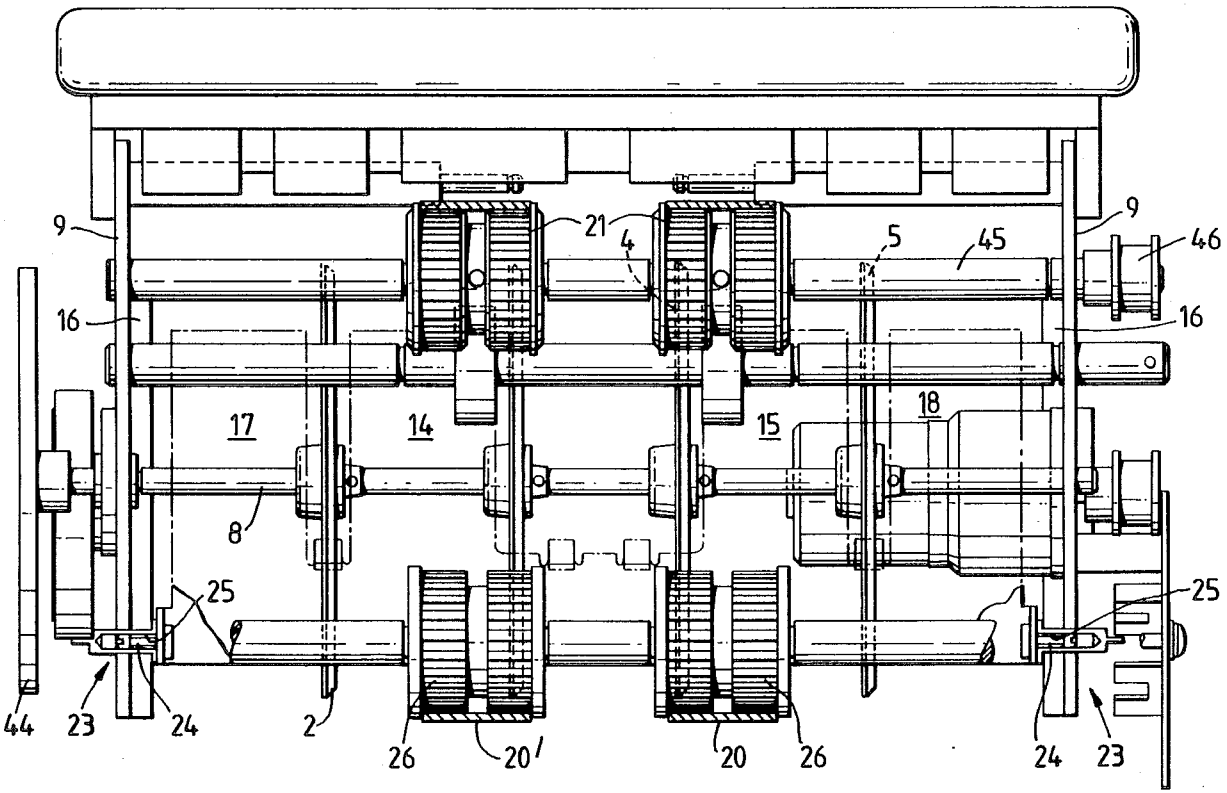

The apparatus illustrated in FIG. 1 forms part of a banknote dispenser of otherwise conventional form in which a selected quantity of banknotes are fed singly from a store (not shown) along a feed path 1 defined by endless belts 11, 11' to a set of four stacking wheels 2–5 (FIG. 2). The endless belts 11, 11' pass around idler pulleys 40 mounted between frame members 9. The belt 11' passes around a drive pulley non-rotatably mounted on a drive shaft 41. A drive pulley 42 is non-rotatably mounted to the shaft 41 externally of a frame member 9 and engages a drive pulley 43. The pulley 43 is driven by a motor (not shown) to cause the belts 11, 11' to carry banknotes along the path 1 to the stacking wheels 2–5.

Each stacking wheel 2–5 comprises a set of curved tines 6 defining sheet receiving slots 7 therebetween. The stacking wheels 2–5 are mounted non-rotatably on a drive shaft 8 supported between the frame members 9. A drive pulley 44 is non-rotatably mounted on the shaft 8 and is driven by the drive motor by virtue of the contact between pulley 43 and a pulley 44A which is coupled with the pulley 44 by an endless belt.

Single sheets fed along the feed path 1 will enter respective sheet receiving slots 7 and be carried in a clockwise direction as seen in FIG. 1 by the stacking wheels 2–5 towards a stripping station 10.

In order to prevent notes from slipping out of the stacking wheels 2–5 as the wheels rotate, a portion 12 of the endless belt 11 extends over the stacking wheels 2–5. The periphery of the stacking wheels moves at a speed less than the speed of movement of the belt 11 and this has the effect of causing the belt 11 to nudge any protruding note back into the stacking wheel slot.

At the stripping station 10 is positioned a stripping device 13 comprising a plate having two sections 14, 15, extending between the stacking wheels 2, 3 and 4,5 respectively and end sections 17, 18. The sections 14, 15, 17, 18 are integrally connected at positions radially outwardly of the stacking wheels 2–5.

The stripping device 13 is attached by tie clamps at two points (one of which 19 is shown in FIG. 1) to respective toothed belts 20,20' in engagement with the smooth outer faces of the toothed belts 20, 20'. The belts 20, 20' are entrained around respective drive pulleys 21 non-rotatably mounted to a shaft 45 journaled between the frame members 9. A drive pulley 46 mounted on the shaft 45 is connected via a belt 47 to a reversable drive motor 22. The drive belts 20, 20' pass around respective tensioners 21' which are movable to adjust the tension of the belts. The belts 20, 20' also extend around idler rollers 26.

The ends of the stripping device 13 remote from the stacking wheels 2–5 include a pair of cam followers 23. Each cam follower 23 includes a pin 24 which is received in a respective slot 25 defined by the frame members 9 and associated guide 16 and providing respective cam surfaces. Thus, the pins 24 are constrained to move within the slots 25 and control the position of the stripping device 13 relative to the belts 20, 20'. The slots have curved portions 25A and rectilinear portions 25B.

In use, sheets held in the sheet receiving slots 7 are stripped out of the slots by the stripping device 13 in its first position shown in solid lines in FIG. 1 and stack against a set of four return plates 27 integrally formed with the device 13. The return plates 27 reregister the bottom edges of any untidily stacked notes.

A microcomputer (not shown) determines when the requried number of sheets has been stacked and then controls the drive motor 22 to cause the pulleys 21 to rotate in a clockwise direction (as seen in FIG. 1). This causes the pins 24 to move in a clockwise direction in the slots 25 thus causing the stripping device 13 to pivot in a clockwise direction to its second position 13' in which the stack of notes 28 is clamped against the belts 20, 20'. At the same time clockwise rotation of the pulleys 21 causes the belts 20, 20' to rotate and causes the stripping device 13 to move with the stack of notes 28 and the belts 20, 20' towards a note presenting station 29 associated with an outlet 30. The stripping device 13 is shown in phantom at 13'' with the clamped stack of notes 28 and part of the clamp 13'' protruding through the present outlet 30. In this position, a user can withdraw the stack of notes. An adjacent sensor 32 senses this removal and, via the microcomputer, actuates the drive motor 22 to cause the pulleys 21 to rotate in an counter-clockwise direction thus withdrawing the stripping device 13 from the present outlet 30 back to the stripping station 10. As the stripping device approaches this position, the pins 24 of the cam follower 23 will cause the stripping device 13 to rotate in an counter-clockwise direction back to the position shown in FIG. 2 due to their movement within the portions 25A of the slots 25.

If the microcomputer determines that the number of sheets in the stack is incorrect, it causes the drive motor 22 to rotate the pulleys 21 initially in an counter-clockwise direction. This causes the stripping device 13 to rotate in an counter-clockwise direction to a dump station 33 where the position of the device 13 is indicated in phantom at 13'''. In this position, the stack of sheets drops into a dump container 34 of conventional form. Once the stack has been released, the drive motor 22 is driven in a clockwise direction and the stripping device 13 returns to the stripping station 10 in the position shown in solid lines in FIG. 1.

Normally, the dispensing apparatus will be positioned in a secure housing indicated schematically at 35.

We claim:

1. A sheet presenting assembly comprising:

a rotatable sheet carrying device having a plurality of sheet receiving slots, said sheet carrying device moving sheets contained in said slots along a first path;

a member defining a movable surface located externally of said first path;

a stripping device movable between a first position which intersects said first path and in which said stripping device strips sheets from a plurality of said sheet receiving slots to form a stack of sheets and a second posiiton in which said stack of sheets is clamped between said stripping device and said movable surface; and drive means adapted to move said stripping device and said movable surface with a stack of sheets clamped therebetween to a sheet-presenting station.

2. An assembly according to claim 1, wherein said stripping device is also movable in cooperation with said movable surface to convey the stack of sheets to a dump station.

3. An assembly according to claim 1, further comprising a cam which is fixed relative to said stripping device, and wherein at least one portion of said stripping device comprises a cam follower cooperating with said cam whereby movement of said cam follower along said cam in response to movement of said stripping device towards said sheet-presenting station causes said stripping device to move from said first position to said second position.

4. An assembly according to claim 3, wherein said stripping device is also movable in cooperation with said movable surface to convey the stack of sheets to a dump station, wherein said cam and cam follower cooperate during movement of said stripping device towards said dump station to cause the stripping device to release the stack.

5. An assembly according to claim 1, wherein said member defining said movable surface comprises at least one endless belt coupled to said stripping device and driven by said drive means.

6. An assembly according to claim 1, wherein said drive means comprises a reversable motor coupled to said stripping device and said member defining said movable surface.

7. An assembly according to claim 1, wherein said stripping device comprises at least one plate.

8. An assembly according to claim 7, wherein said at least one plate is pivotally mounted relative to said movable surface.

9. An assembly according to claim 1, wherein said sheet carrying device comprises at least one rotatably driven stacking wheel.

10. Banknote dispensing apparatus including:

(A) a sheet presenting assembly comprising:

(1) a rotatable sheet carrying device having a plurality of sheet receiving slots, said sheet carrying device moving said sheets contained in said slots along a first path;

(2) a member defining a movable surface located externally of said first path;

(3) a stripping device movable between a first position which intersects said first path and which said stripping device strips sheets from said sheet carrying device to form a stack of sheets and a second position in which said stack of sheets is clamped between said stripping device and said movable surface; and (4) drive means adapted to move said stripping device and said movable surface with a stack of sheets clamped therebetween to a sheet-presenting station; and (B) banknote feed apparatus for feeding a selected quantity of banknotes to said sheet presenting assembly.

* * * * *